United States Patent [19]

Kieler

[11] Patent Number: 4,704,875

[45] Date of Patent: Nov. 10, 1987

[54] BEVERAGE COOLER

[76] Inventor: David R. Kieler, 183 Winterhaven Cir., Palm Desert, Calif. 92260

[21] Appl. No.: 928,564

[22] Filed: Nov. 10, 1986

[51] Int. Cl.[4] ..... F25D 3/08

[52] U.S. Cl. ..... 62/372; 62/457; 220/20; 220/DIG. 9

[58] Field of Search ..... 62/371, 372, 457; 220/20, DIG. 9

[56] References Cited

U.S. PATENT DOCUMENTS

| | | | |
|---|---|---|---|
| 1,021,670 | 3/1912 | Garey | 62/457 X |
| 1,979,222 | 10/1934 | Goodwin | 62/457 X |
| 3,605,435 | 9/1971 | Taylor | 62/457 |
| 4,250,998 | 2/1981 | Taylor | 62/371 X |
| 4,280,336 | 7/1981 | Taylor | 62/371 X |
| 4,286,440 | 9/1981 | Taylor | 62/371 X |
| 4,531,381 | 7/1985 | Toro et al. | 62/372 |
| 4,541,539 | 9/1985 | Matthews | 220/20 |

*Primary Examiner*—William E. Tapolcai
*Attorney, Agent, or Firm*—Harvey S. Hertz

[57] ABSTRACT

A beverage cooler comprises a housing member of generally rectangular configuration. The housing includes a bottom horizontal wall and a plurality of generally vertical side and end walls which are integrally formed with the bottom horizontal wall to define an enclosure having a top opening. Coolant and consumable items normally are inserted in the cooler through the top opening and a cover member is positioned over the vertical walls to form an enclosed container. Sleeve numbers extend through at least one on the vertical wall members and are integral therewith. The sleeve members form an integral outer surface with the wall members for preventing cool air from leaking from the interior of the cooler. The sleeve members enable beverage containers to be inserted therein so that the containers can be cooled by being adjacent the cool air in the interior of the beverage cooler.

2 Claims, 2 Drawing Figures

BEVERAGE COOLER

BACKGROUND OF THE INVENTION

1. Field of the invention

Invention relates in general to beverage coolers and, more particularly, to a beverage cooler having sleeves integrally formed with the walls of the beverage cooler for enabling beverage containers to be in cool, yet remain accessible from the exterior of the cooler.

2. Description of the prior art

Conventional beverage coolers normally form a tight sealed insulated package with coolant and consumable items kept in the interior of the beverage cooler. When it is necessary to consume the food or beverage in the cooler, the cooler is opened and the food or beverage removed and consumed. Once the food or beverage has been removed from the cooler, it normally reaches room temperature at a relatively fast pace. Particularly, when consuming beverages, it is desirable that the beverage remain cool while consumption occurs. In certain arrangements, the beverages are placed in the coolant and then removed from the coolant as consumption occurs. However, such arrangements are not desirable as the coolant, such as ice, will normally melt rather rapidly.

Known prior art includes U.S. Pat. Nos. 1,681,110; 4,037,428; 4,441,336; 3,940,249; 4,393,665; French Patent No. 2,327,746; and German Patents 120,261 and 598,350.

SUMMARY OF THE INVENTION

A beverage cooler comprising a housing member of generally rectangular configuration having a bottom horizontal wall, and a plurality of generally vertical side and end walls integrally formed with the bottom horizontal wall to define an enclosure having a top opened for inserting coolant and consumable items in the cooler. The cover member is positioned on the vertical walls to cover the cooler and form an enclosed container. Sleeve members extend through at least one of the vertical wall members and are integral therewith. The sleeve members form an integral outer surface with the wall members and prevent cool air from leaking from the cooler. The sleeve members enable beverage containers to be inserted therein for enabling the containers to be cool by being adjacent the cool air in the interior of the beverage cooler. The advantages of this invention, both as to its construction and mode of operation, will be readily appreciated as the same becomes better understood by reference to the following detailed description, when considered in connection with the accompanying drawings, in which like reference numerals designate like parts throughout the figures.

DESCRIPTION OF THE PREFERRED EMBODIMENTS

Figure 1:
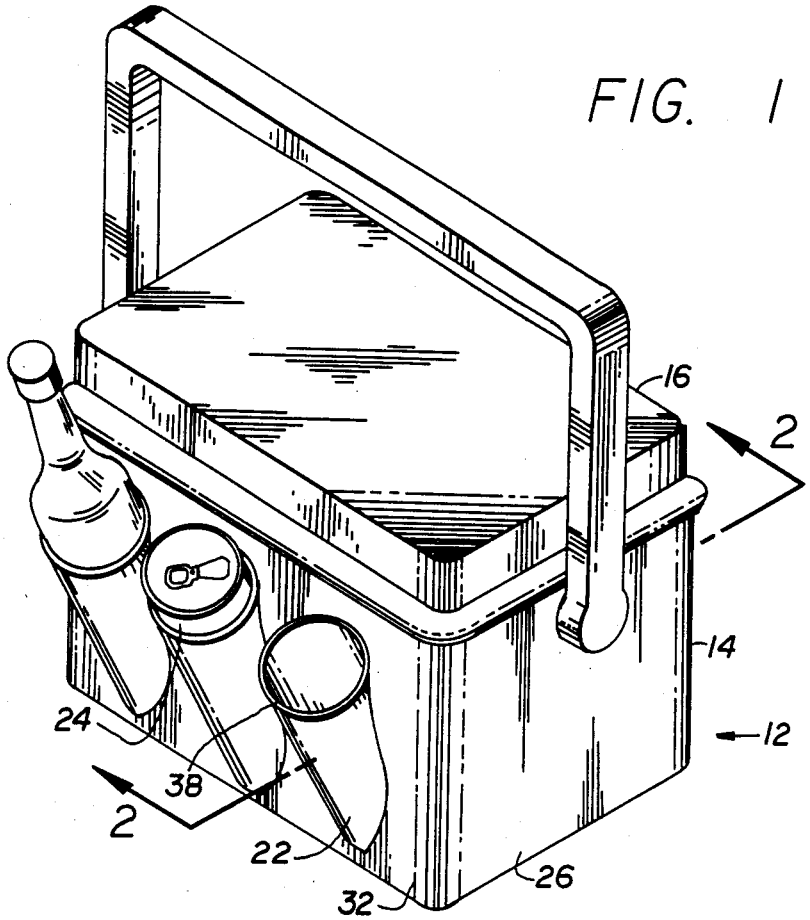
FIG. 1 is a perspective view illustrating the beverage cooler.
Figure 2:
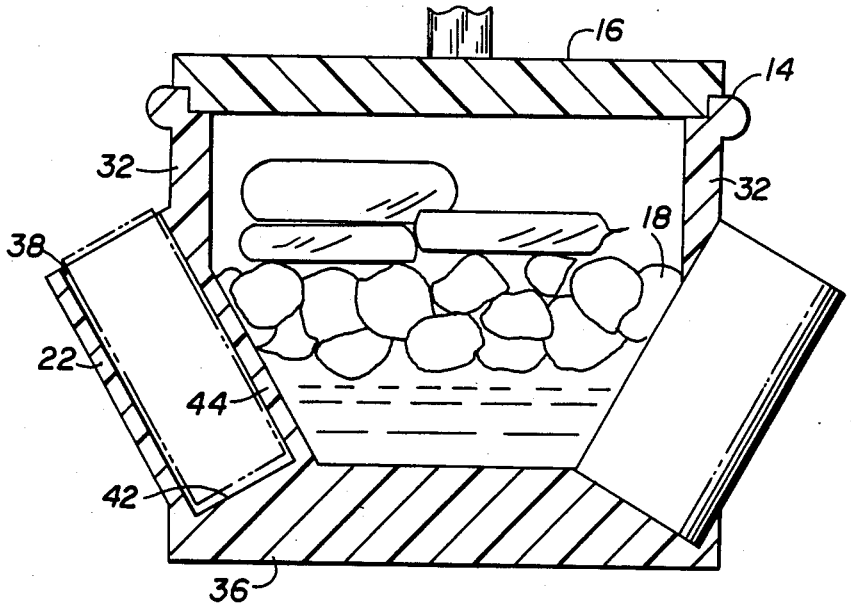
FIG. 2 is a cross sectional view taken along the line 2—2 of FIG. 1.

Referring now to the drawings there is shown in FIG. 1 a beverage cooler 12 constructed in accordance with the principles of the invention. The beverage cooler is of conventional design contains a housing 14 and a cover 16. Typically, the cooler made of molded plastic material which forms a natural insulating member, although other material could be used as well. As is conventional, coolant such as ice 18 (FIG. 2) can be placed in the housing. In addition, beverages can be placed in the housing. In addition, beverages and consumable food may be placed therein as well as is conventional.

In the present invention, a plurality of sleeves 22 are integrally formed with the housing 14. The sleeves extend from the exterior of the housing into the interior thereof and enables beverage cans 24 to be inserted therein. The sleeves 22 being accessible from the exterior of the cooler 12, enable the beverage cooler 12 to hold the beverage cans 24 during consumption. In addition, as the sleeves extend into the interior of the cooler, the beverage can can remain relatively cool due to the contact of the interior portion of the sleeve 22 with the ice 18 contained in the beverage cooler 12.

The beverage cooler housing 14 contains an opposed pair of vertical end walls 26 which are joined by a pair of vertical side walls 32 and together with a bottom wall 36 define the housing 14. In addition, as is conventional, the cover 16 is positioned over the top end of the housing to form the enclosed beverage cooler.

The sleeves 22 extend at an acute angle with respect to the plane of the vertical side walls 32 into the interior of the cooler housing 14. The sleeves 22 are open at their exterior end 38 and are normally of a diameter so that a conventional twelve ounce beverage can be inserted therein. However, it should be understood that the sleeves can be any size or shape enabling for example a bottle of wine to be inserted therein and kept cool as well as illustrated in FIG. 1.

The sleeves 22 are normally integrally formed with the housing side walls 32. If the housing 14 is made of moulded plastic, the sleeves 22 can normally be moulded simultaneously during the manufacturing process. The sleeves 22 extend through the side walls 32 and terminate normally adjacent the housing bottom wall 36.

Typically, the sleeve bottom 42 can be integral with or a part of the interior bottom wall 36 of the housing. The sleeve side wall 44 extends through the interior of the housing side walls 32 and the ice 18 in the cooler housing 14 normally rests against the outer surface of the sleeve side wall 44. Normally, the sleeve wall 44 thickness is less than that of the side walls 32 so that the beverage cans 24 can be kept as close as possible to the ice is. A beverage can 24 in the sleeve 22 will be cooled as the temperature of the air in the cooler is conducted through the sleeve interior side walls 44 to the beverage can 24. Thus, the beverage can 24 can be consumed and remain cool simultaneously.

While the drawings illustrate a housing 14 having three sleeves in each of the side walls 32, it should be understood that additional sleeves can be placed in the end walls 26 as well. In addition, it should be noted that the housing could be made larger to accept additional sleeves along the housing side and end walls.

I claim:

1. A beverage cooler comprising:

a housing member of generally rectangular configuration having a bottom horizontal wall, a plurality of generally vertical side and end walls integrally formed with the bottom horizontal wall to define an enclosure having a top opening for inserting coolant and consumable items in said cooler;

a cover member positioned on said vertical walls to cover said cooler and form an enclosed closure; and at least one sleeve member whose axis extends at an angle through the plane of at least one of said vertical wall members, said sleeve member forming an integral outer surface with said wall members for preventing cooled air from leaking from the cooler, said sleeve member enabling beverage containers to be inserted therein from the exterior of said housing member for enabling the containers to be cooled by being adjacent to cool air in the interior of said beverage cooler, the sleeve member portion being integral with the outer surface extending into the interior portion of said housing defining said enclosure, and the sleeve member having a portion exterior of said wall member which is open for enabling a beverage container to be inserted into said sleeve, the end of said beverage container initially inserted into said sleeve abutting the sleeve member portion integral with said outer surface.

2. A beverage cooler in accordance with claim 1 wherein the wall of said sleeve member formed in the interior of said cooler are thinner than the wall member which said sleeve forms an integral part thereof.

* * * * *